United States Patent [19]

King et al.

[11] Patent Number: 4,599,116

[45] Date of Patent: Jul. 8, 1986

[54] ALKALINE CLEANING PROCESS

[75] Inventors: Peter F. King, Farmington Hills; Samuel T. Farina, Mt. Clemens; Karl A. Korinek, Troy, all of Mich.

[73] Assignee: Parker Chemical Company, Madison Heights, Mich.

[21] Appl. No.: 669,491

[22] Filed: Nov. 8, 1984

[51] Int. Cl.[4] ..... C23G 1/14

[52] U.S. Cl. ..... 134/2; 134/3; 134/27; 134/29; 134/40; 252/156; 427/327; 427/444

[58] Field of Search ..... 134/2, 27, 28, 29, 40, 134/3; 252/156; 427/327, 444

[56] References Cited

U.S. PATENT DOCUMENTS

| | | | |
|---|---|---|---|
| 3,653,095 | 4/1972 | Dupre et al. | 134/2 X |
| 4,048,121 | 9/1977 | Chang | 252/156 X |
| 4,091,954 | 5/1978 | Wallace | 220/470 |
| 4,116,849 | 9/1978 | Leikhim | 134/2 X |
| 4,124,407 | 11/1978 | Binns | 134/3 |
| 4,317,685 | 3/1982 | Ahuja | 134/27 |
| 4,349,448 | 9/1982 | Steele | 134/2 X |
| 4,457,322 | 7/1984 | Rubin et al. | 134/2 |
| 4,477,290 | 10/1984 | Carroll et al. | 134/2 X |

FOREIGN PATENT DOCUMENTS 2102838 2/1983 United Kingdom .

OTHER PUBLICATIONS

R. Pinner, Electroplating and Metal Finishing Jul. 1967, pp. 208 et seq.

*Primary Examiner*—Peter Hruskoci

*Attorney, Agent, or Firm*—Arthur E. Kluegel

[57] ABSTRACT

An aqueous alkaline cleaning composition and process for cleaning aluminum container surfaces in a manner to inhibit objectionable white-etch staining during prolonged cleaning cycles and brown oxide discoloration during prolonged rinse cycles in which the cleaning solution contains an alkalinity agent or agents present in an amount sufficient to remove aluminum fines from the surfaces thereof, a complexing agent present in an amount to complex at least some of the metal ions in the cleaning solution which tend to form insoluble precipitates and at least one surfactant present in an amount sufficient to remove organic soils from the surfaces being cleaned and to suppress the formation of white-etch staining of the surfaces during prolonged cleaning cycles. The surfactant or blend of surfactants employed are further characterized by at least one having a Hydrophile-Lipophile Balance (HLB ratio) of at least about 12. The aqueous cleaning composition can optionally further contain an antifoaming agent to suppress objectionable foaming.

21 Claims, No Drawings

ALKALINE CLEANING PROCESS

BACKGROUND OF THE INVENTION

The present invention broadly relates to an aqueous alkaline cleaning composition and process, and more particularly to a process employing an aqueous alkaline cleaner for cleaning aluminum container surfaces which are characterized by poor draining characteristics resulting in entrapment of the cleaning solution. The present invention is particularly adaptable for cleaning drawn and ironed aluminum container bodies of the types employed in the packaging of foodstuffs and beverages. The cup-shaped and dished integral bottom of such container bodies are conducive to entrapment of the cleaning solutions during processing which has resulted in an objectionable localized staining of the surfaces thereof during line stoppages during the cleaning cycle and prior to the subsequent water rinsing of the containers. Entrapment of the cleaning solution can also occur between cans at their points of contact while supported on the conveyor preventing satisfactory draining of the cleaning solution.

Line stoppages are a frequent occurrence in high-capacity, high-speed container washers the operation of which is integrated with other components of the container manufacturing line and may be occasioned, for example, by changeovers in the container decorating equipment as well as providing for periodic maintenance of sections of the production line. In any event, line stoppages ranging from about one-half minute to as long as about one hour frequently occur whereby the containers in the cleaning section of high-capacity, high-speed multiple stage washers are retained in the cleaning section for prolonged time periods having entrapped cleaning solution on at least portions of the surfaces thereof.

The localized etching evidenced by a white-etch staining of the surfaces of such containers occasioned by line stoppages is objectionable not only from an appearance standpoint but has also been found to detract from the adherence of subsequent sanitary lacquer coatings and decorative coatings applied to the container surfaces.

In addition to the aforementioned localized etching problem which produces a white staining on the surfaces of the container, a further problem has been encountered with respect to the surfactants or detergents employed which are necessary to remove the lubricants and other organic soils from the surface of the container body. It has been observed that surfactants heretofore employed have been deficient in many respects in preventing redeposition of such lubricants and organic soils on the cleaned container surface as the concentration of such lubricants and organics increases in the cleaning solution during prolonged usage. The redeposition of such organics on the container surface detracts from achieving optimum adherence of subsequently applied coatings to the container surfaces.

Still a further problem encountered when employing alkaline cleaners for cleaning aluminum container surfaces has been the tendency, in some instances, to produce a brown oxide stain or discoloration on the container surfaces during subsequent water rinsing of the cleaned container bodies. Such brown stains are objectionable not only from an appearance standpoint but also interfere in the attainment of optimum adherence of subsequently applied lacquer coatings.

A variety of aqueous alkaline cleaning compositions have heretofore been used or proposed for use for cleaning of substrates including glass containers and bottles. For example, U.S. Pat. No. 2,976,248 discloses an alkaline cleaner for glass jars employing an inhibitor to reduce corrosion of the mild steel conveyor belt employed in transferring the bottles through the washer mechanism; U.S. Pat. No. 4,147,652 discloses an alkaline cleaner concentrate also for cleaning glass bottles which is of relatively high alkalinity and optionally contains a chelating agent to prevent scale formation from hard water metal ions; U.S. Pat. No. 2,992,995 discloses a highly concentrated alkaline cleaner for cleaning superalloy engine parts to remove metal deposits therefrom; U.S. Pat. No. 3,779,933 discloses an alkaline oven cleaning composition which is highly concentrated and is devoid of any complexing agents while employing fatty acid soap ingredients unsuitable for use in accordance with the practice of the present invention; and U.S. Pat. No. 4,094,701 which discloses an alkaline cleaner for tin surfaces which is devoid of any complexing agents for the metal surface being cleaned. The foregoing prior art patents while generally applicable for cleaning substrates are directed to cleaning surfaces which are either insensitive to staining or discoloration such as glass, employ ingredients, and/or concentration of ingredients unsuitable for cleaning sensitive metal surfaces such as aluminum, or omit essential ingredients such as complexing agents which are necessary for use in the commercial practice of the present invention. U.S. Pat. No. 4,477,290 relates to an aqueous alkaline composition for cleaning aluminum containers which does not use or need surfactants and is unsuitable in practice as demonstrated by the tables in the Description of the Preferred Embodiment.

The process of the present invention overcomes the staining or localized discoloration problem of metal surfaces associated with prior art alkaline cleaners by incorporating a selected surfactant or combination of surfactants in further combination with conttrolled amounts of supplemental ingredients effecting an efficient and uniform cleaning of aluminum surfaces at relatively low temperatures while at the same time improving the flavor characteristics of the containers. The process for cleaning aluminum substrates in accordance with the present invention is further characterized by its versatility, flexibility, and ease of control and operation. At present, no alkaline cleaners have achieved commercial acceptance for use on aluminum containers.

SUMMARY OF THE INVENTION

The benefits and advantages of the present invention are achieved in accordance with the process aspects thereof, by employing an aqueous alkaline cleaning composition containing an alkalinity agent present in an amount to achieve satisfactory removal of aluminum fines without incurring undesirable etching of the aluminum surfaces. Generally, the operating bath is of a pH of at least about 10 and an alkalinity agent, a complexing agent present in an amount effective to complex at least some of the metal ions in the operating bath which tend to form bath insoluble precipitates of which sugar acids and salts thereof comprise preferred materials such as, for example, sodium gluconate and sodium citrate; and one or a combination of selected surfactants in an amount sufficint to remove the organic soils present on the substrate being cleaned and to prevent a buildup of such organic soils in the cleaning solution preventing a redeposition thereof and to inhibit white etch staining. The composition may optionally contain a foam-suppressant agent of any of the types conventionally employed depending on the types of surfactants used in the cleaning composition and the manner by which the aqueous cleaning composition is applied to the substrate to minimize undesirable foaming thereof.

A make-up or replenishment of the cleaning composition can be effected by employing a dry-powdered concentrate of the active constituents or, alternatively, can comprise a concentrated aqueous solution or slurry facilitating addition and admixture with the operating cleaning composition during use.

In accordance with the process aspects of the present invention, the aqueous alkaline cleaner is applied at moderate temperatures generally below about 150° F. to about ambient (i.e., about 60° F.), and preferably at about 90° to about 130° F. to a substrate being cleaned such as by flooding, immersion or preferably, by spray application for a period of time sufficient to effect a cleaning thereof. The discovered alkaline cleaner provides improved taste characteristics to aluminum beverage containers compared to conventional acid cleaning. A further advantage is that this alkaline cleaning process produces less scale and sludge during commercial operating than heretofore observed in alkaline cleaning processes. A still further advantage is that alkaline processes are less corrosive to steel processing equipment than conventional acid cleaners. It has been also discovered that it is desirable to subsequently rinse an alkaline cleaned surface with an aqueous based neutral or acidulated rinse solution at a controlled pH to remove residual cleaning solution therefrom whereafter it is subjected to further treatments as may be desired or required. It has been further discovered that a treatment of alkaline cleaned aluminum containers to apply a conversion coating preferably at a coating weight below that traditionally employed for purposes of corrosion protection and adhesion promotion on at least the outside surfaces thereof provides an unexpected improvement in their mobility in high-speed can lines, that is, in can lines having a capacity greater than about 1000 cans per minute.

DESCRIPTION OF THE PREFERRED EMBODIMENTS

The aqueous alkaline cleaning composition employed in the process of the present invention contains as its essential constituents an alkalinity agent or mixture of alkalinity agents present in an amount sufficient to achieve satisfactory removal of aluminum fines from the container surfaces, a complexing agent present in an amount sufficient to complex at least some of the metal ions in the operating bath which tend to form precipitates in the aqueous alkaline medium, one or a combination of surfactants having an HLB ratio above about 12 percent in an amount effective to remove organic soils from the aluminum container surfaces and to inhibit white-stain etching of the surfaces during line stoppages, and optionally, a foam depressant agent.

The alkalinity agent may comprise any one or a combination of bath soluble and compatible compounds including alkali or alkaline earth metal borates, carbonates, hydroxides, phosphates as well as mixtures thereof of which alkali metal hydroxides and alkali metal carbonates constitute the preferred materials. The alkalinity agent is controlled in the operating bath at a concentration effective to remove substantially all of the aluminum fines on the container surfaces while at the same time not unduly etching the aluminum surface so as to provide a clean, bright, reflective appearance. The alkalinity agent is typically employed to provide an operating pH of at least about 10 with an upper pH limit dictated by economics typically at a pH of about 13 depending upon the specific conditions and type of metal substrate to be cleaned. Preferably, the pH of the operating cleaning solution is controlled within a range of about 11.5 up to about 12.5. In order to provide the foregoing alkalinity, the alkalinity agent or combinations thereof are conventionally employed at a concentration of from about 0.05 up to about 10 g/l with concentrations of about 0.4 to about 3.5 g/l being preferred. A particularly satisfactory alkalinity agent comprises a mixture of sodium hydroxide and sodium carbonate.

The complexing agent may comprise any one or a combination of bath soluble and compatible compounds which are effective to complex at least some of the metal ions present in the operating bath to avoid the formation of deleterious precipitates. For this purpose, sugar acids as well as salts thereof are generally preferred. Included among such complexing agents suitable for use in the alkaline cleaner of the present invention are gluconic acid, citric acid, glucoheptanoic acid, sodium tripolyphosphate, EDTA, tartaric acid or the like, as well as the bath soluble and compatible salts thereof and mixtures thereof. Generally, the concentration of the complexing agent in the operating bath is controlled within a range of about 0.01 up to about 5 g/l with concentrations of from about 0.05 to about 1 g/l being preferred.

A third essential ingredient of the alkaline cleaning solution comprises a surfactant which is characterized as having a Hydrophile-Lipophile Balance (HLB ratio), i.e., the balance of the size and strength of the hydrophilic (water-loving or polar) and the lipophilic (oil-loving or non-polar) groups of the molecule, of at least about 12, preferably at least about 12 to about 15. Generally speaking, the HLB ratio for some non-ionic surfactants comprises an indication of the percentage weight of the hydrophilic portion of the molecule and in some instances can be directly calculated. The percentage is then divided by the factor of 5 providing an assigned HLB number. Certain other non-ionic surfactants as well as ionic surfactants do not accurately correlate with the weight percentage of the hydrophilic portion because such hydrophilic portions are more effective and accordingly, the appropriate apparent HLB ratio can be established experimentally. It is now well established to assign HLB values to many commercially available surfactants which information can be employed to best advantage in the practice of the present invention. For further information regarding the determination of the HLB number of surfactants and emulsifying agents, reference is made to Chapter 7, pages 18 and 19 of a publication entitled "The Atlas HLB System", Third Edition, 1963, by Atlas Chemical Industries, Inc.

In accordance with the present invention, it has been discovered that a surfactant or possibly a combination of surfactants of which at least one has an HLB number of at least about 12 is necessary to effect an efficient removal of lubricants and organic soils of the types customarily employed in the drawing and ironing of aluminum containers achieving proper cleaning at relatively low concentrations while inhibiting white etch stain. When the surfactant has an HLB number in excess of about 15, it has further been discovered that increased amounts of surfactant are generally necessary to achieve satisfactory cleaning of the container bodies and to avoid undesirable buildup of the concentration of organic soils in the aqueous alkaline cleaning composition which tend to redeposit on the container surfaces detracting from efficient cleaning. Accordingly, the surfactant employed in accordance with the preferred practice of the present invention has an HLB ratio ranging from at least about 12 up to about 15.

It has been further discovered, that when a surfactant or blend of surfactants of which at least one has an HLB ratio at least about 12, that the white etch staining or discoloration of the aluminum container surfaces occasioned by line stoppages in the cleaning stage of the container washer are substantially eliminated. It has further been observed that the inhibition of such white etch staining further improves as the HLB number of the surfactant or blend of surfactants is increased. In accordance with the present invention, in order to achieve satisfactory cleaning, avoidance of a buildup of organic lubricants and soils in the aqueous cleaning composition, to enable the use of a minimum amount of surfactant in the cleaning solution and to concurrently inhibit or eliminate white etch staining of the containers, an HLB number of the surfactant or at least one of the combination of surfactants is preferably controlled within at least about 12 up to about 15, and especially from about 13 to about 15.

Surfactants which have been found particularly satisfactory for use in accordance with the present invention include Tergitol 15-S-9 reportedly comprising an ethoxylated secondary alcohol (HLB about 13.5) available from Union Carbide Corporation; Neodol 91-8 reportedly comprising an ethoxylated linear alcohol (HLB about 14.1) commercially available from Shell Chemical Company; and Igepal CA630 reportedly comprising an ethoxylated alkyl nonyl phenol (HLB about 13.0) commercially available from GAF Corporation.

Surfactants suitable for use in the practice of the present invention include, for example, those having hydrophobic groups comprising alkyl phenols, linear alcohols, branched-chain alcohols, secondary alcohols, propylene oxide/propylene glycol condensates, or the like; hydrophillic groups such as ethylene oxide, ethylene oxide/ethylene glycol condensates, or the like which may further contain capping groups such as propylene oxide, chloride, benzyl chloride, amines, or the like.

Hydrocarbon alkoxylated surfactants of the foregoing types can be represented by the general structural formula:

$$R(OR')_nOH$$

Wherein:

R is a hydrocarbon containing 6 to 30 carbon atoms,

R' is $C_2$ or $C_3$ and mixtures thereof, and n is an integer of from 5 to 100.

The foregoing molecules can be capped employing conventional capping groups in accordance with known techniques.

The surfactant or combination of surfactants can be employed in the aqueous cleaner composition in concentrations which are effective to remove organic soils from the container surfaces to provide a substantially 100 percent water-break-free surface while at the same time avoiding residue oil build-up in the cleaner and inhibiting the formulation of white stain etching of the aluminum surfaces during line stoppages. Typically, the surfactant or combination of surfactants are employed at concentrations ranging from about 0.003 up to about 5 g/l with concentrations ranging from about 0.02 to about 1.0 g/l being preferred.

Depending upon the particular type of surfactant or surfactants used, the manner of application of the cleaning solution to the aluminum containers and the concentration and processing parameters, it is further contemplated that an antifoaming agent can also be incorporated in the cleaning composition to avoid objectionable foaming. Any one of a variety of commercially available antifoaming agents can be employed for this purpose of which agents based on micro-crystalline wax have been found particularly satisfactory.

The particular mechanism by which the surfactants suppress staining of the surfaces of the substrate being cleaned is not understood at the present time. It has been observed, however, that surfaces which are characterized by poor draining characteristics when cleaned in accordance with the present invention have not experienced localized staining in such areas of solution entrapment upon standing for prolonged periods of time at moderate temperatures in the presence of localized accumulations of cleaning solution thereon. In the case of drawn and ironed aluminum containers, such localized staining detracts from the bright reflective appearance of the cleaned container and also adversely affects the adhesion of subsequent sanitary lacquer coatings and decorative inks and coatings applied thereto resulting in a container which is commercially unsatisfactory. Avoidance of such localized staining during interruptions and line stoppages in multiple stage commercial container washers provides for a substantial improvement in the quality of the cans produced as well as in a substantial reduction or elimination of defective cans. A special advantage of the discovered alkaline cleaning process is that neither silicates, phosphates, nor fluorides are required to obtain the desired results which is an advantage from the rinsability and environmental and safety standpoints.

In accordance with the present invention, the aqueous alkaline cleaning composition is applied to the substrate at comparatively low to moderate temperatures of generally below about 150° F., to about ambient (i.e, about 60° F.) and preferably within a range of about 90° to about 130° F. The contacting of the substrates to be cleaned can be effected by flooding, immersion, or spraying of which the latter constitutes the preferred technique particularly when substrates of complex configuration are being cleaned to assure uniform contact with the surfaces thereof. The makeup and replenishment of the cleaning composition is performed by employing a concentrate of the several constituents in the appropriate proportions. The concentrate can be provided in the form of a dry particulated product and preferably, in the form of an aqueous concentrate containing from about 50 percent up to about 90 percent by weight water with the balance comprising the active ingredients present in the same relative proportions as employed in the final diluted operating bath.

In accordance with a preferred practice of the present invention, the containers are subjected to a pre-wash before being contacted with the aqueous alkaline cleaner composition. The pre-wash is effective to remove a portion of the aluminum fines and soils from the container reducing buildup of such contaminants in the succeeding cleaning step. The pre-wash may comprise water and preferably, comprises a dilute solution of the alkaline cleaner, i.e., a concentration of from about one-fiftieth to about one-half the concentration of the operating cleaning bath and typically, about one-tenth. This can conveniently be achieved by counter-flowing cleaning solution from the primary cleaning stage into the pre-wash stage in addition to make-up water. The pre-wash stage is typically operated within the range of temperatures employed in the primary cleaner stage although higher temperatures can be used, if desired, due to the relatively low concentration of constituents without achieving undue etching of the aluminum surfaces.

In accordance with a further discovery of the present invention, it has been found that a brown oxide discoloration of alkaline cleaned aluminum containers resulting from a water rinsing thereof following the cleaning stage can be substantially eliminated by employing a water rinse in which the pH thereof is maintained at substantially neutral or on the acidic side. Because of a carry-over or drag-out of the aqueous alkaline cleaning solution into the following rinse stage, such rinse generally becomes progressively alkaline. In order to avoid any buildup in alkalinity of the subsequent rinse stages, it has been found necessary to effect an overflow of the rinse (flow limited due to water use and treatment restrictions) and/or a neutralization of an alkaline buildup such as by the addition of acid to maintain the pH of the rinse solution at a level preferably less than about pH 7.5 and preferably at about pH 7 or below. By maintaining the subsequent water rinse solutions at a neutral or acidic pH, the formation of brown stains on the aluminum container bodies is substantially eliminated with or in the absence of line stoppages in the rinsing stage.

In accordance with still a further discovery of the present invention, it has been discovered that mobility problems sometimes occur when aluminum containers are cleaned employing aqueous alkaline cleaners including alkaline cleaners of the type herein described. The mobility problems manifest themselves in high-speed can lines, i.e., can lines having a production capacity in excess of about 1,000 cans per minute, such as, for example 1,250 cans per minute and higher. At such high-speed transfers, the sliding and rolling ability of cans in contact with each other and with the equipment while moving through the various conveyorized transfer lines and chutes is impeded in some instances causing objectionable jamming. It has been discovered that subjecting alkaline cleaned aluminum containers to a conversion treatment following rinsing unexpectedly increases their mobility enhancing their high-speed transfer in such high-speed can lines and also improves stain resistance. The conversion coating treatment on at least the exterior surfaces of the aluminum containers may be any one conventionally available including, for example, treatment solutions based on chromium phosphate or titanium, zirconium, or hafnium with or without tannin. Exemplary of such conversion coating solutions and processes are those described in U.S. Pat. Nos. 4,017,334; 4,054,466, and 4,338,140 the teachings of which are incorporated herein by reference. Coating levels below these conventionally employed are satisfactory for this purpose.

In order to further illustrate the improved aqueous alkaline cleaner composition and process of the present invention, the following specific examples are provided. It will be understood that the examples are provided for illustrative purposes and are not intended to be limiting of the scope of the present invention as herein described and as set forth in the subjoined claims.

EXAMPLE 1

An aqueous alkaline cleaning composition was prepared for use in a power spray can washer containing a total of 19 liters of cleaning solution. To 19 liters of water, 70 grams of sodium hydroxide, 70 grams of sodium gluconate, and 20 grams of various commercially available container body-making lubricants were added to simulate an aged cleaner and thereafter incremental amounts of specific surfactants of different HLB numbers and of three different chemical types were incrementally added until water-break-free containers were obtained indicating satisfactory cleaning. This experiment did not evaluate the white-etch staining inhibition of the surfactants but rather, the efficacy of their ability to remove commercial body-making lubricants from the container surfaces. In each test, the aqueous cleaner composition was applied to commercially manufactured open-ended aluminum containers by spray for a period of 1 minute at 110° F. For Table 4, the content was reduced to 20 grams sodium hydroxide and 20 grams sodium gluconate and employed at 125° F. and in Table 5 the sodium gluconate content was further reduced to 8 grams. The results from these tests are set forth in Tables 1–5 for the three different types of surfactants and three different commercially available body lubricants employing surfactants within each series of different HLB ratio.

TABLE 1

| SURFACTANT* | HLB RATIO | G. SURFACTANT/ G. LUBRICANT** |
|---|---|---|
| Igepal CO 210 | 4.6 | >5 |
| Igepal CO 530 | 10.8 | 1 |
| Igepal CA 630 | 13.0 | 0.35 |
| Igepal CO 720 | 14.6 | 2 |
| Igepal CO 850 | 16.0 | 1.5 |
| Igepal DM 880 | 17.2 | >3.5 |

*Alkylated phenol ethoxylate surfactants from GAF Corporation.
**Quakerol 602 LVB Body Lubricant from Quaker Chemical Company

TABLE 2

| SURFACTANT* | HLB RATIO | G. SURFACTANT/ G. LUBRICANT** |
|---|---|---|
| Tergitol 15-S-3 | 8.0 | >5 |
| Tertitol 15-S-7 | 12.1 | 1.5 |
| Tergitol 15-S-9 | 13.5 | 0.75 |
| Tergitol 15-S-12 | 14.5 | 1 |
| Tergitol 15-S-15 | 15.4 | 2 |

*Secondary alcohol ethoxylate surfactants from Union Carbide Corporation
**Quakerol 602 LVB Body Lubricant

TABLE 3

| SURFACTANT* | HLB RATIO | G. SURFACTANT/ G. LUBRICANT** |
|---|---|---|
| Neodol 91-2.5 | 8.1 | >4.8 |
| Neodol 91-8 | 14.1 | 0.5 |

*Linear alcohol ethoxylate surfactants from Shell Chemical Co.
**Quakerol 602 LVB Body Lubricant

TABLE 4

| SURFACTANT | HLB RATIO | G. SURFACTANT/ G. LUBRICANT** |
|---|---|---|
| Igepal CO 530 | 10.8 | >3.5 |

TABLE 4-continued

| SURFACTANT | HLB RATIO | G. SURFACTANT/ G. LUBRICANT** |
|---|---|---|
| Igepal CA 620 | 12.0 | 2 |
| Igepal CA 730 | 14.6 | >3.5 |

**Quakerol 538 Body Lubricant from Quaker Chemical Co.

TABLE 5

| SURFACTANT | HLB RATIO | G. SURFACTANT G. LUBRICANT** |
|---|---|---|
| Igepal CO 210 | 4.6 | >3.5 |
| Igepal CA 620 | 12.0 | 1 |
| Igepal DM 880 | 17.2 | 0.5 |
| Igepal CO 997 | 19.0 | 0.2 |

**Quakerol 548 Body Lubricant from Quaker Chemical Co.

It will be noted in Tables 1–5, that in some instances a water-break-free container surface was not obtained in spite of relatively high additions of specific surfactants and such data are indicated where the quantity of surfactant per gram lubricant is indicated as being greater than the number listed. From the test data presented, there is a clear indication that those surfactants having a low HLB ratio tend to require a higher concentration of surfactant to overcome the adverse effect of the accumulation of lubricant in the cleaning composition in order to achieve satisfactory cleaning. The data further indicates that at an HLB ratio above about 11, a lower concentration of surfactant is required. It is further noted that as the HLB ratio of the surfactant increase above about 15, an increase in surfactant concentration is required to achieve satisfactory cleaning with respect to certain body-making lubricants.

EXAMPLE 2

Selected ones of the cleaned aluminum cans containing maximum surfactant concentrations as listed in prior Tables 1–5 were further subjected to standing in atmosphere for a period of one/half hour with residual alkaline cleaning solution on the surfaces thereof to simulate a typical line stoppage. At the completion of the one-half hour dwell period, the surface appearance of each of the containers was inspected for the presence of white etch staining. A comparative numerical rating system was adopted for rating the magnitude of white etch staining on the exterior surfaces of the aluminum test containers employing a scale of from 1 to 5 with the rating of 5 representing no staining at all while number 1 represents commercially unacceptable severe staining. A rating of about 3 is considered the minimum required for a commercially acceptable cleaned aluminum container surface.

The results of this test are set forth in Table 6 for the various types of surfactants of varying HLB ratio employing Quakerol 602 LVB Body Lubricant in all instances with the exception of one test in which the body lubricant comprised Quakerol 548.

TABLE 6

| SURFACTANT | HLB RATIO | STAIN RATING |
|---|---|---|
| Igepal CO 210 | 4.6 | 1 |
| Igepal CO 530 | 10.8 | 2 |
| Igepal CA 620 | 12.0 | 2.5 |
| Igepal CA 730 | 14.6 | 3 |
| Igepal CO 850 | 16.0 | 4 |
| Igepal DM 880 | 17.2 | 4 |
| Igepal CO 997 | 19.0 | 4* |
| Neodol 91-6 | 12.5 | 3.5 |
| Tergitol 15-S-3 | 8.0 | 2 |

TABLE 6-continued

| SURFACTANT | HLB RATIO | STAIN RATING |
|---|---|---|
| Tergitol 15-S-5 | 10.5 | 1 |
| Tergitol 15-S-7 | 12.1 | 2 |
| Tergitol 15-S-9 | 13.5 | 3.5 |
| Tergitol 15-S-12 | 14.5 | 4 |
| Tergitol 15-S-15 | 15.5 | 3 |

*Quakerol 548 Body Lubricant; all other Quakerol 602 LVB.

It is apparent from the data as presented in Table 6, that the magnitude of the objectionable white etch staining decreased as the HLB ratio of the surfactants increased. In general, depending upon the specific type of surfactant and the body lubricant employed, acceptable containers were produced when the HLB ratio was above about 12. The data clearly demonstrate the surprising and unexpected result of the HLB ratio of surfactants employed in inhibiting objectional white etch staining of aluminum containers as occasioned by prolonged line stoppages.

EXAMPLE 3

An aqueous alkaline cleaning composition was prepared by first preparing a dry concentrate containing on a weight percent basis, 60 percent sodium hydroxide, 10 percent sodium gluconate, 20 percent soda ash, 5 percent of Tergitol 15-S-9 surfactant (HLB ratio=13.5), 3 percent of a microcrystalline wax based defoaming agent and 2 percent sodium citrate. The ingredients were dry mixed to form a uniform blend and 200 grams of the resultant mixture were added to 190 liters of water at a temperature of 125° F. for use in the first stage of a pilot spray can washer. A series of drawn and ironed commercial aluminum container bodies taken from the trimmer of a body maker production line and containing lubricant and aluminum fines on the surfaces thereof were cleaned in the pilot washer by spray application for a period of 40 seconds simulating a commercial production operation. The resultant cleaned cans after subsequent water rinsing were observed to be water-break-free and free of residual aluminum fines.

EXAMPLE 4

In order to illustrate a further discovery of the present invention in accordance with the process aspects thereof, aluminum containers cleaned in accordance with the aqueous alkaline cleaning composition and processing parameters as described in Example 3 were subjected to a further prolonged water rinsing in Stage 2 of the pilot washer employing rinse solutions at different controlled temperatures and different controlled pH. The cleaned containers were subjected to a continuous spray rinse for alternate periods of 15 minutes and 30 minutes in the spray rinse stage simulating typical line stoppages in commercial multiple stage can washing apparatuses.

The rinse water employed comprised Detroit, Mich. tap water of a nominal pH of about 6.8 to about 7.0. Increases in the alkalinity or pH of the rinse solution were made by the addition of controlled amounts of the alkaline cleaner employed in the cleaning Stage 1 of the pilot washer simulating drag-in of alkaline cleaner into the following rinse stage.

At the conclusion of each rinse cycle, the surfaces of the containers were examined for the presence of any brown oxide discoloration as a function of time, temperature and pH. A discoloration rating was assigned to each container thus processed and the results thereof are set forth in Table 7. It will be noted, that any visible discoloration of the container surface is considered commercially unacceptable.

TABLE 7

| Time, Mins. | Temp °F. | pH | Discoloration Rating |
|---|---|---|---|
| 15 | 130 | 7.5 | None |
| 30 | 130 | 7.5 | None |
| 15 | 130 | 10.0 | Yellow Brown |
| 30 | 130 | 10.0 | Yellow Brown |
| 15 | 130 | 10.5 | Yellow Brown |
| 30 | 130 | 10.5 | Yellow Brown |
| 15 | 130 | 11.0 | Yellow Brown |
| 30 | 130 | 11.0 | Yellow Brown |
| 15 | 74 | 7.9 | Slight Yellow |
| 30 | 78 | 7.9 | Yellow |
| 15 | 80 | 7.0 | None |
| 30 | 80 | 7.0 | None |
| 15 | 80 | 7.5 | None |
| 30 | 80 | 7.5 | None |
| 15 | 80 | 7.9 | None |
| 30 | 80 | 7.9 | Yellow |
| 15 | 115 | 7.9 | Slight Yellow |
| 30 | 115 | 7.9 | Yellow |
| 15 | 115 | 7.5 | None |
| 30 | 115 | 7.5 | None |

It is apparent from a study of the data as set forth in Table 7 that the tendency for the objectionable brown oxide discoloration to form on the aluminum container bodies increases with the duration of the rinse cycle, the temperature of the rinse solution and the pH of the rinse solution. Under the specific conditions investigated, it is apparent that by maintaining the rinse solution at a pH of less than about 7.5 avoidance of any brown discoloration is effected at the specific rinse temperatures and spray durations investigated. Accordingly, in commercial practice, maintenance of the water rinse solution at a pH of below about 7.5 can be effected by the addition of an appropriate acidic substance, preferably, sulfuric acid, to overcome the progressive contamination of the rinse solution with the aqueous alkaline cleaner from the prior cleaning stage. A counterflowing of the rinse solution through a multiple stage rinse section with an overflow of rinse water from the stage following the cleaning stage also reduces the progressive increase of pH in the rinse solution.

EXAMPLE 5

Aluminum cans cleaned in accordance with Example 3 were further subjected, after rinsing, to a dilute conversion coating treatment employing an aqueous acidic treating solution of a type described in U.S. Pat. No. 4,338,140. The coated cans were observed to have improved mobility on high-speed commercial can lines.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. In a process for the alkaline cleaning of aluminum containers having aluminum fines and organic soils on the surfaces thereof, which process includes contacting said surfaces with an aqueous alkaline cleaning composition for a period of time sufficient to remove substantially all of the aluminum fines and organic soils on the surfaces thereof and thereafter rinsing the cleaned surfaces with an aqueous based at least partially recirculated rinse solution to remove residual cleaning composition from the surfaces thereof, during which process portions of the alkaline cleaning composition are carried into the rinse solution causing a buildup in the alkalinity of the rinse solution;

the improvement comprising adding an acidic component to said rinse solution in amounts sufficient to maintain the pH value of said rinse solution at a value less than about 7.5 to prevent said buildup and substantially eliminate the formation of brown oxide stains on said cleaned surfaces.

2. The process as defined in claim 1 including the further step of controlling the temperature of said cleaning composition below about 150° F.

3. The process as defined in claim 1 including the further step of controlling the temperature of said cleaning composition within a range of about 90° to about 130° F.

4. The process as defined in claim 1 including the further step of contacting the aluminum surface with an aqueous pre-wash solution prior to contact with said alkaline cleaning composition.

5. The process as defined in claim 4 in which said pre-wash solution comprises a dilute solution of said aqueous alkaline cleaning composition.

6. The process of claim 1 wherein the cleaning composition is silicate, phosphate and fluoride free.

7. The process of claim 1 comprising contacting at least the exterior cleaned and rinsed container surfaces with a treating solution to apply a conversion coating thereon.

8. The process as defined in claim 7 in which said treating solution is selected from the group based on chromium phosphate, titanium, zirconium and hafnium in the presence or absence of tannin.

9. The process of claim 1 wherein the cleaned and rinsed surface is subjected to a conversion coating.

10. The process of claim 1 wherein the cleaning step comprises contacting the surfaces of the aluminum containers with an aqueous alkaline cleaning composition containing an alkalinity agent present in an amount to remove aluminum fines from the surfaces of the containers, a complexing agent present in an amount effective to complex at least some of the metal ions dissolved from the surfaces by the cleaning composition and which tend to form bath insoluble precipitates, and at least one surfactant present in an amount effective to remove the organic soils on the surfaces of the container and to inhibit white-etch staining of the surfaces during prolonged contact with the cleaning composition, said surfactant and having an HLB number greater than about 12, and continuing the contacting of the surfaces with said cleaning solution until the desired cleaning is effected.

11. The process as defined in claim 10 in which said cleaning composition further contains an antifoaming agent present in an amount to suppress objectionable foaming.

12. The process as defined in claim 10 in which at least one of the surfactants has an HLB number of at least about 12 up to about 15.

13. The process as defined in claim 10 in which said alkalinity agent is present in an amount to provide a pH of at least about 10.

14. The process as defined in claim 10 in which said alkalinity agent is present in an amount to provide a pH of about 11.5 to about 12.5.

15. The process as defined in claim 10 in which said alkalinity agent is present in an amount of about 0.05 to about 10 g/l.

16. The process as defined in claim 10 in which said complexing agent is present in an amount of about 0.01 to about 5 g/l.

17. The process as defined in claim 10 in which said complexing agent is present in an amount of about 0.05 to about 1 g/l.

18. The process as defined in claim 10 in which said surfactant is present in an amount of about 0.003 to about 5 g/l.

19. The process as defined in claim 10 in which said surfactant is present in an amount of about 0.02 to about 2.0 g/l.

20. The process as defined in claim 10 in which said surfactant comprises a hydrocarbon alkoxylated surfactant of the general structural formula:

$$R(OR')_nOH$$

Wherein:

R is a hydrocarbon containing 6 to 30 carbon atoms, R′ is $C_2$ or $C_3$ and mixtures thereof, and n is an integer of from 5 to 100.

21. The process of claim 10 wherein the rinsed surface is then subjected to conversion coating.

* * * * *